US005436125A

United States Patent [19]

Hagemann et al.

[11] Patent Number: 5,436,125

[45] Date of Patent: Jul. 25, 1995

[54] COLOR PHOTOGRAPHIC RECORDING MATERIAL CONTAINING COMBINATION OF PHENOLIC LIGHT STABILIZERS WITH NOVEL POLYCYCLIC PHENOLS AS COLOR STABILIZERS FOR THE MAGENTA PYRAZOLOAZOL TYPE AZOMETHINE DYES

[75] Inventors: Jörg Hagemann, Cologne; Beate Weber, Leichlingen, both of Germany

[73] Assignee: Agfa-Gevaert AG, Leverkusen, Germany

[21] Appl. No.: 281,623

[22] Filed: Jul. 28, 1994

[30] Foreign Application Priority Data

Aug. 9, 1993 [DE] Germany ..... 43 26 647.9

[51] Int. Cl.[6] ..... G03C 7/392

[52] U.S. Cl. ..... 430/551; 430/554; 430/555; 430/558

[58] Field of Search ..... 430/551, 554, 555, 558

[56] References Cited

U.S. PATENT DOCUMENTS 5,104,782 4/1992 Seto et al. ..... 430/551

*Primary Examiner*—Lee C. Wright

*Attorney, Agent, or Firm*—Connolly & Hutz

[57] ABSTRACT

In a color photographic recording material, the light stability of a dye image produced from a magenta coupler and stabilized with a compound of the formula I may be further improved by additionally using a compound of one of the formulae II and III.

(I)

(II)

(III)

In the formulae I, II and III, $R^1$, $R^{21}$, $R^{25}$, $R^{31}$, $R^{34}$ mean H, alkyl, aryl, acyl;

$R^2$, $R^{22}$, $R^{32}$ mean $—OR^1$ alkyl, aryl, dialkylamino, acylamino, sulphonamido, acyl, sulphonyl;

$R^3$, $R^4$, $R^5$, $R^6$, $R^{23}$, $R^{24}$, $R^{33}$ mean H, halogen or a residue as $R^2$;

m, n, q mean 0, 1, 2 or 3;

o means 0, 1 or 2;

p means a positive integer;

A means alkylene, —O—, —S—, $—NR^{25}—$, $—SO_2$;

B means alkylene, —O—, —S—, $—NR^{34}—$, $—SO_2—$;

wherein two adjacent residues $—OR^1$, $R^2$, $R^3$, $R^4$, $R^5$, $R^6$ may together complete a 5- to 8-membered ring, two adjacent residues $—OR^{21}$, $R^{23}$, $R^{22}$ or $—OR^{21}$, $R^{24}$, $R^{22}$, or $—OR^{31}$, $R^{33}$ or $R^{32}$, $R^{33}$ may together complete a 5- or 6-membered ring, wherein $R^{22}$ or $R^{32}$ are not identical to $—OR^{21}$ or $—OR^{31}$ respectively, if $R^{21}$ or $R^{31}$ is H, and wherein two residues $R^{31}$ are not simultaneously H.

7 Claims, No Drawings

COLOR PHOTOGRAPHIC RECORDING MATERIAL CONTAINING COMBINATION OF PHENOLIC LIGHT STABILIZERS WITH NOVEL POLYCYCLIC PHENOLS AS COLOR STABILIZERS FOR THE MAGENTA PYRAZOLOAZOL TYPE AZOMETHINE DYES

The present invention relates to a photographic recording material with at least one silver halide emulsion layer which contains a combination of phenolic light stabilisers with novel polycyclic phenols as colour image stabilisers for the magenta pyrazoloazole type azomethine dyes produced during chromogenic development.

It is known to product colour photographic images by chromogenic development, i.e. by developing silver halide emulsion layers which have been exposed in accordance with the image by means of suitable chromogenic developer substances, known as colour developers, in the presence of suitable colour couplers, wherein the oxidation product of the developer substances, which is formed congruently with the silver image, reacts with the colour coupler forming a dye image. Aromatic compounds containing primary amino groups, particularly those of the p-phenylenediamine type, are conventionally used as colour developers.

It is also known that the colour image dyes formed by chromogenic development undergo different degrees of change under the action of environmental conditions. The action of light is particularly striking in this respect. As is known, the magenta dyes produced from pyrazolone and pyrazoloazole couplers are particularly severely bleached under the action of light, while the cyan dyes produced from phenolic couplers are particularly insensitive in this respect.

Considerable efforts have been made to remedy this deficiency by special measures. In the case of magenta couplers it has, in fact, proved possible to achieve improved light stability by means of light-stabilising additives or special formulations of the couplers. Suitable light-stabilising agents are substantially phenolic compounds, in particular hydroquinone derivatives, which are either mixed with the couplers or are attached to the coupler molecules as substituents (DE-B-1 547 803, DE-A-26 17 826, DE-A-29 52 511, JP-N 53 070 822, JP-N 54 070 830, JP-N 54 073 032). However, known light stabilisers do not fulfil the requirements expected of them in every respect.

The object of the invention is to provide a combination of light stabilisers for photographic recording materials, in particular such a combination which brings about a distinct improvement in the light stability of magenta image dyes produced from magenta couplers, particularly those of the pyrazolone or pyrazoloazole type.

The present invention provides a colour photographic recording material with at least one silver halide emulsion layer and a colour coupler associated with this layer, characterised in that it contains in a silver halide emulsion layer or in an adjacent non-photosensitive binder layer a combination of at least one magenta coupler, at least one compound of the general formula I and at least one compound of one of the formulae II and III:

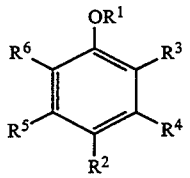

(I)

in which $R^1$ means H, alkyl, aryl, acyl;

$R^2$ means —$OR^1$, —COOH, alkyl, aryl, dialkylamino, acylamino, sulphonamido, acyl, sulphonyl;

$R^3$, $R^4$, $R^5$, $R^6$ mean H, halogen or a residue as $R^2$;

wherein two adjacent residues —$OR^1$, $R^2$, $R^3$, $R^4$, $R^5$, $R^6$ may together complete a 5- to 8-membered ring,

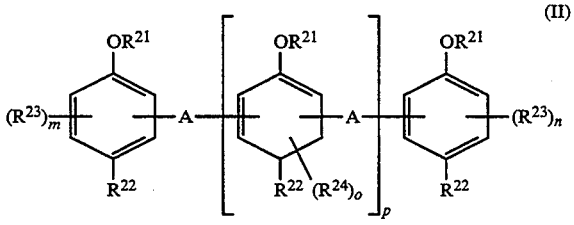

(II)

in which $R^{21}$ means residues as $R^1$;

$R^{22}$ means residues as $R^2$;

$R^{23}$, $R^{24}$ mean residues as $R^3$;

A means alkylene, —O—, —S—, —$NR^{25}$—, —$SO_2$—;

$R^{25}$ means a residue as $R^1$;

m, m mean 0, 1, 2, or 3;

o means 0, 1 or 2;

p means a positive integer;

wherein two or more residues $R^{21}$ to $R^{24}$ may each be the same or different (the same applies to two or more parameters o) and wherein adjacent residues —$OR^{21}$, $R^{23}$, $R^{22}$ or —$OR^{21}$, $R^{24}$, $R^{22}$ may complete an optionally substituted 5- or 6-membered ring, and wherein $R^{22}$ is not identical to —$OR^{21}$ if $R^{21}$ is H,

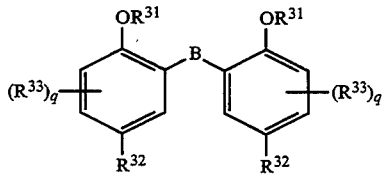

(III)

in which $R^{31}$ means residues as $R^1$;

$R^{32}$ means residues as $R^2$;

$R^{33}$ means residues as $R^3$;

B means alkylene, —O—, —S—, —$NR^{34}$—, —$SO_2$;

$R^{34}$ means a residue as $R^1$;

q means 0, 1, 2 or 3;

wherein two or more residues $R^{31}$ to $R^{33}$ may each be identical or different, with the restriction that two residues $R^{31}$ are not simultaneously H and wherein adjacent residues —$OR^{31}$ and $R^{33}$ or $R^{32}$ and $R^{33}$ may complete an optionally substituted 5- or 6-membered ring, and wherein $R^{32}$ is not identical to —$OR^{21}$ if $R^{31}$ is H.

An alkyl group represented by one of the residues $R^1$ to $R^{33}$ or contained therein may be unbranched, branched or cyclic and optionally mono- or polysubstituted. Possible substituents are those stated for $R^3$.

An acyl group represented by one of the residues $R^1$ to $R^{33}$ or contained therein may be derived from an aliphatic or aromatic carboxylic, phosphoric, phosphonic or phosphorous acid, a carbamic acid or a carbonic acid semi-ester.

An alkylene group represented by A or B may be unbranched, branched or cyclic and optionally mono- or polysubstituted. Possible substituents are those stated for $R^3$.

In a preferred embodiment of the invention, $R^{21}$ and one of the residues $R^{31}$ denotes H, and A and B denote alkylene, $—SO_2—$ or —S—.

In further particularly preferred embodiments of the invention, the compound of the formula I corresponds in particular to one of the formula Ia to Ig:

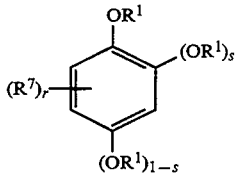

Ia

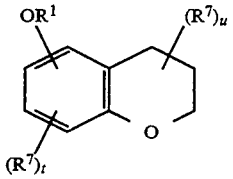

Ib

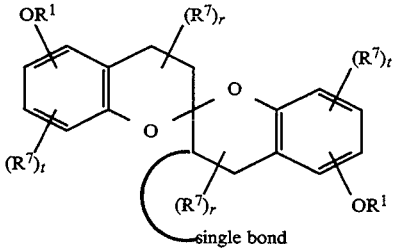

Ic

-continued

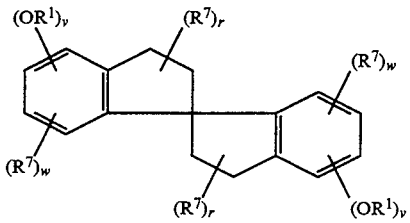

Id

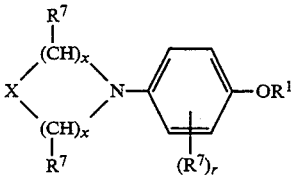

Ie

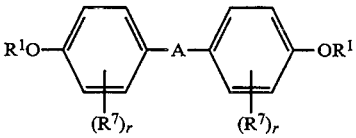

If

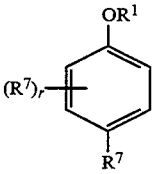

Ig in which:

$R^7$ means alkyl, acyl, acylamino, sulphonamido, sulphonyl;

X means —O—, —S—, —SO—, $—SO_2—$, —Nacyl—, —CO—;

r means 0, 1, 2, 3 or 4;

s means 0 or 1;

t means 0, 1, 2 or 3;

u means 0, 1, 2, 3, 4, 5 or 6;

v means 1 or 2;

w means 0, 1 or 2;

x means 1, 2 or 3.

Two or more residues $R^7$ or r, t, v, w, x may be identical or different. The statement made for $R^1$ to $R^{33}$ applies to the acyl group contained in the residue X (formula Ie).

Examples of compounds according to the invention of the formula I are:

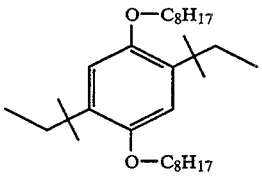

I-1

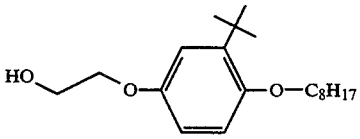

I-2

-continued
I-3
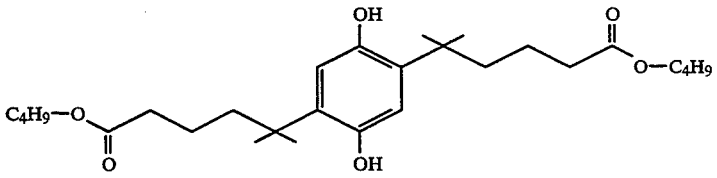
I-4
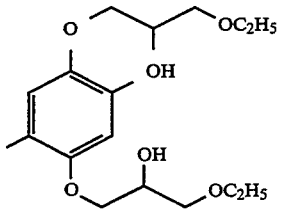
I-5
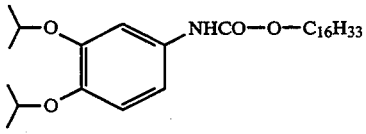
I-6
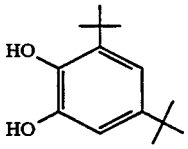
I-7
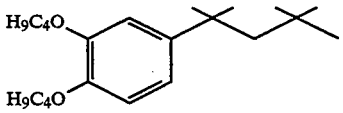
I-8
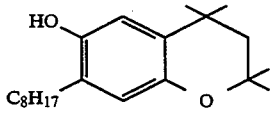
I-9
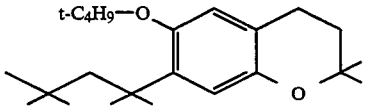
I-10
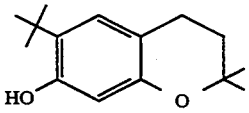
I-11
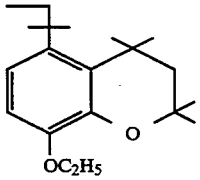
I-12
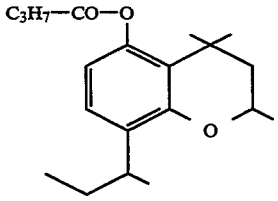

-continued
I-13
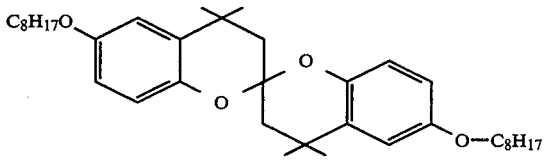
I-14
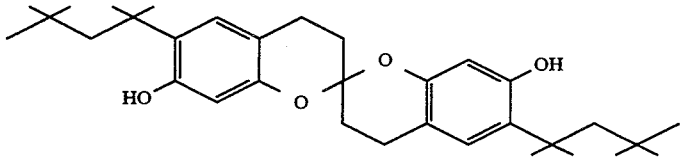
I-15
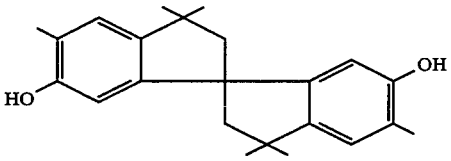
I-16
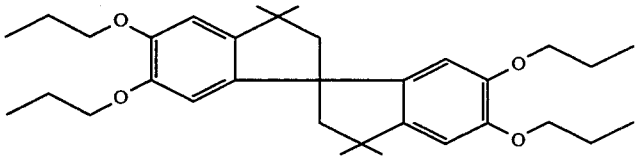
I-17
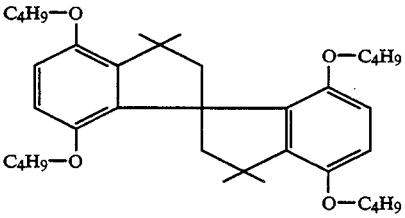
I-18
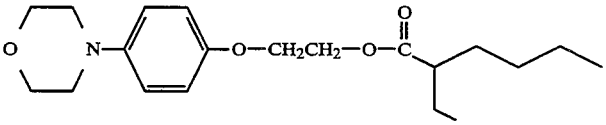
I-19
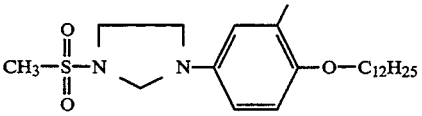
I-20
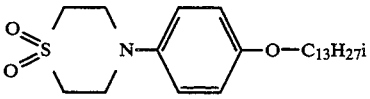
I-21
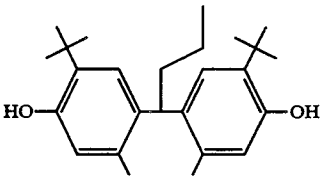

-continued
I-22
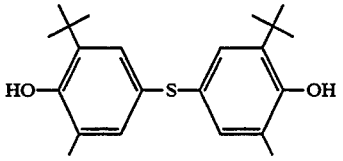
I-23
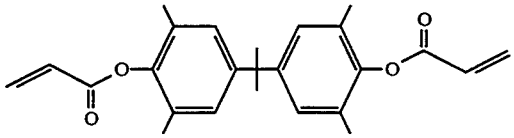
I-24
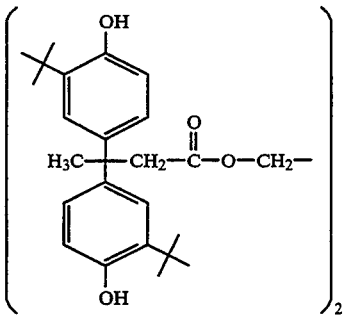
I-25
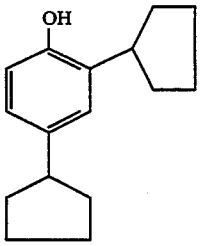
I-26
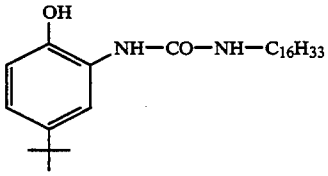
I-27
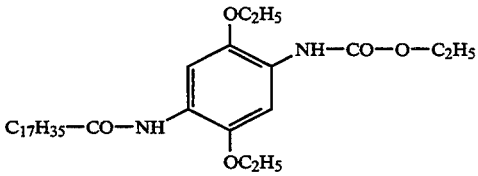
I-28
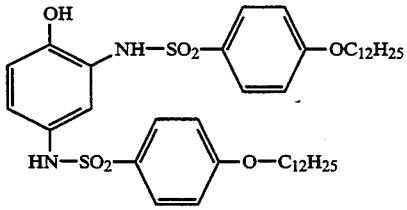
I-29
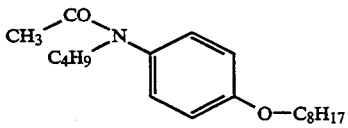

-continued
I-30
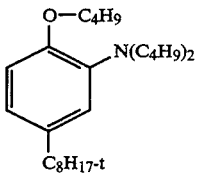
I-31
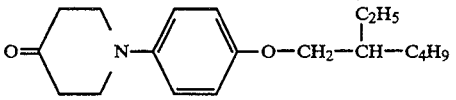
Examples of compounds according to the invention of the formula II are:
II-1
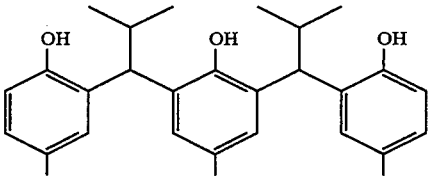
II-2
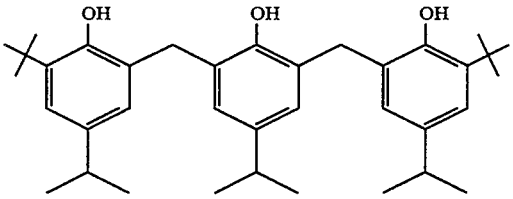
II-3
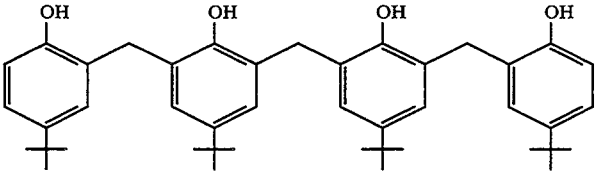
II-4
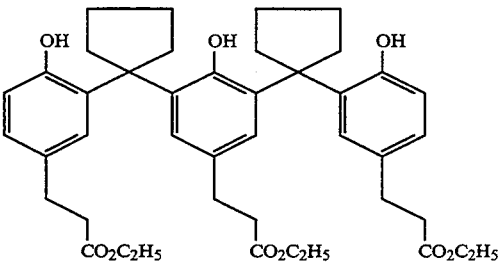
II-5
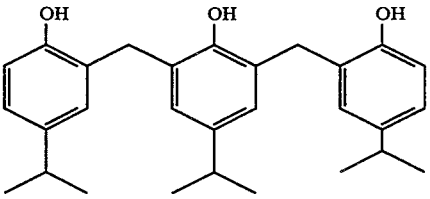

-continued
II-6
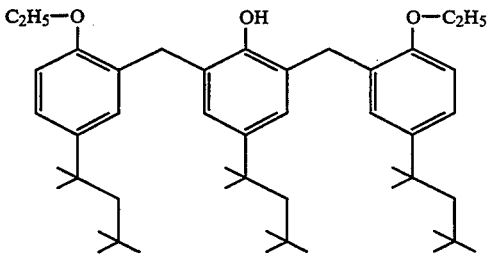
II-7
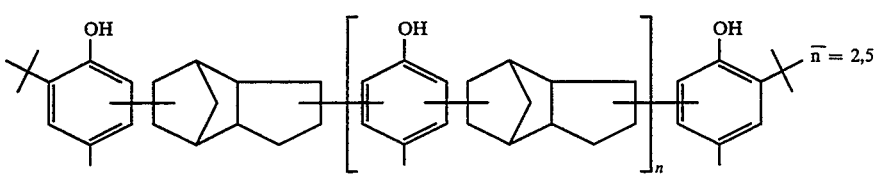
II-8
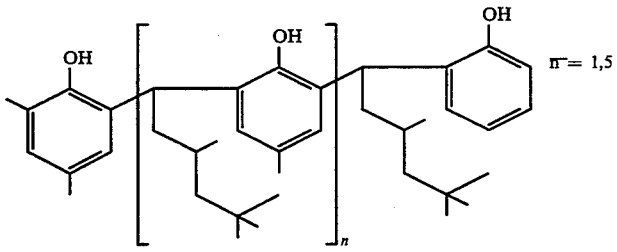
II-9
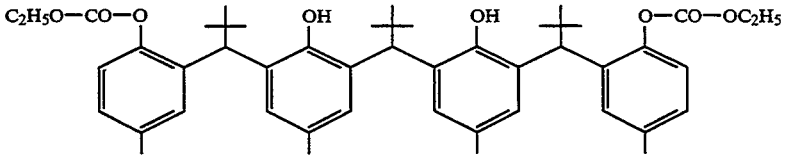
II-10 as II-7, but with $\bar{n}=1.7$
II-11 as II-7, but with $\bar{n}=3.8$
Examples of compounds according to the invention of the formula III are:
III-1
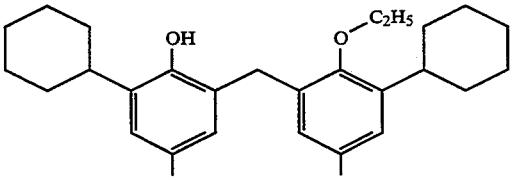
III-2
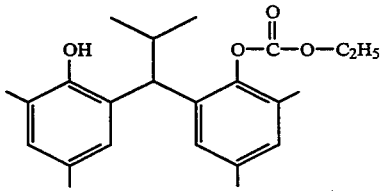
III-3
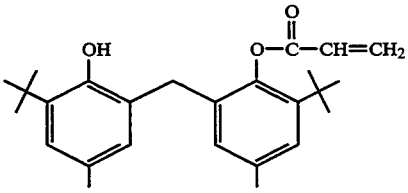
-continued
III-4
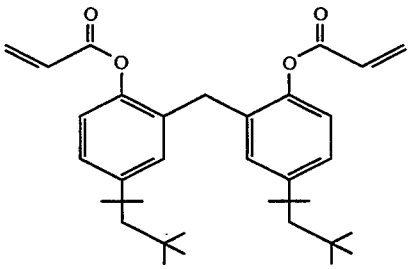
III-5
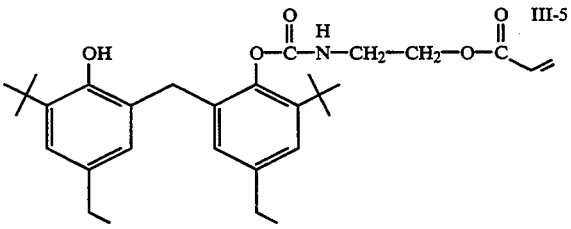

-continued

III-6

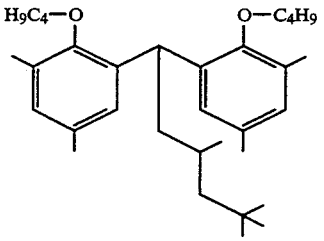

The colour photographic recording material according to the invention contains at least one photosensitive silver halide emulsion layer and preferably a sequence of two or more such photosensitive silver halide emulsion layers and optionally further auxiliary layers, such as in particular protective layers and non-photosensitive binder layers arranged between the photosensitive layers, wherein according to the present invention, a compound according to the invention of the formula I, at least one compound of one of the formulae II and II and at least one magenta coupler are associated with at least one of the photosensitive silver halide emulsion layers present.

The combination according to the invention of compounds of the formula I with compounds of one of the formulae II and III has a light stabilising action, i.e. the azomethine dyes formed from the colour couplers on chromogenic development exhibit in the presence of the combination according to the invention distinctly increased stability against the action of light. The stability of the dyes is also improved against the action of heat and moisture.

The quantity ratios of the compounds of the formula I to compounds of the formulae II and III may be varied over a broad range. The quantities of all the dyes of the formula I to the dyes of the formulae II and III are preferably present in a ratio of 1:3 to 20:1, preferably 1:1 to 10:1.

The compounds according to the invention are, for example, used as a solution in aprotic (hydrophobic) solvents, for example ethyl acetate, for incorporation into the pouring solution for the layer concerned, optionally together with the appropriate colour coupler. Incorporation is performed in the customary manner, wherein further auxiliary solvents and/or high-boiling coupler solvents, so-called oil formers, may optionally be used.

The silver halide present as the photosensitive constituent in the photographic recording material according to the invention may contain chloride, bromide or iodide or mixtures thereof as the halide. The halide content of at least one layer may, for example, comprise 0 to 15 mol. % iodide, 0 to 100 mol. % chloride and 0 to 100 mol. % bromide.

In the case of colour negative and colour reversal films, silver bromide-iodide emulsions are customarily used, in the case of colour negative and colour reversal paper silver chloride-bromide emulsions with a high chloride content up to pure silver chloride emulsions are customarily used. The crystals may be predominantly compact, for example regularly cubic or octahedral or they may have transitional shapes. Preferably, however, lamellar crystals may also be present, the average ratio of diameter to thickness of which is preferably at least 5:1, wherein the diameter of a grain is defined as the diameter of a circle the contents of which correspond to the projected surface area of the grain. The layers may, however, also have tabular silver halide crystals, in which the ratio of diameter to thickness is substantially greater than 5:1, for example 12:1 to 30:1.

The silver halide grains may also have a multi-layered grain structure, in the simplest case with one internal zone and one external zone of the grain (core/shell), wherein the halide composition and/or other modifications, such as for example doping, of the individual grain zones are different. The average grain size of the emulsions is preferably between 0.2 μm and 2.0 μm, the grain size distribution may be both homodisperse and heterodisperse. homodisperse grain size distribution means that 95% of the grains deviate by no more than ±30% from the average grain size.

The emulsions may, in addition to the silver halide, also contain organic silver salts, for example silver benzotriazolate or silver behenate.

Two or more types of silver halide emulsions which are produced separately may be used as a mixture.

The emulsions may be chemically and/or spectrally sensitised in the customary manner; they may also be stabilised with suitable additives. Suitable chemical sensitisers, spectral sensitising dyes and stabilisers are, for example, described in *Research Disclosure* 17 643 (December 1978); particular reference is made to sections III, IV and VI.

In addition to the usually green-sensitised silver halide emulsion layer containing the combination according to the invention of magenta coupler and compounds of the formulae I and II or III, the colour photographic recording material according to the invention preferably contains further silver halide layers to record light of the red and blue ranges of the spectrum. To this end, the photosensitive layers are spectrally sensitised in a known manner with suitable sensitising dyes.

An overview of the polymethine dyes suitable as spectral sensitisers, the suitable combinations of the dyes and the combinations with supersensitising effects is contained in *Research Disclosure* 17 643 (December 1978), section IV.

Suitable green sensitisers are, for example, 9-ethylcarbocyanines with benzoxazole, naphthoxazole or a benzoxazole and a benzothiazole as basic terminal groups, together with benzimidazocarbocyanines, which may also be further substituted and must also contain at least one sulphoalkyl group on the heterocyclic nitrogen.

The green sensitisers GS listed below may be cited by way of example, each of which may be used individually or in combination, for example GS-1 and GS-2.

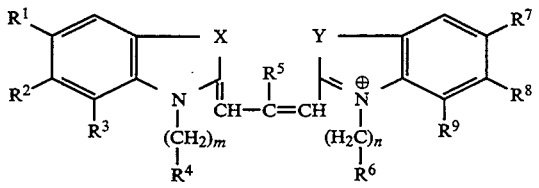

GS-1: $R^1$, $R^3$, $R^7$, $R^9$=H; $R^2$=phenyl;

$R^4 = -\underset{\underset{CH_3}{|}}{CH}-SO_3^{\ominus\oplus}NH(C_2H_5)_3$;

$R^5$=—$C_2H_5$; $R^6$=—$SO_3\ominus$; $R^8$=Cl; m=2; n=3; X, Y=O;

GS-2: $R^1$, $R^2$, $R^7R^8$=Cl; $R^3$, $R^5$, $R^6$, $R^9$=H;

$$R^4 = -\underset{\underset{CH_3}{|}}{CH}-SO_3\ominus;$$

m, n=2; X, Y=N—$C_2H_5$

GS-3: $R^1$, $R^7$=H; $R^2$, $R^3$ and $R^8$, $R^9$ together —CH=CH—CH=CH—; $R^4$=$SO_3\ominus Na\oplus$; $R^5$=$C_2H_5$; $R^6$=$SO_3\ominus$; m, n=3; X, Y=O;

GS-4: $R^1$, $R^3$, $R^4$, $R^7$, $R^8$, $R^9$=H; $R^2$=—$OCH_3$; $R^5$=—$C_2H_5$; $R^6$=$SO_3\ominus$; m=2; n=4; X=O; Y=S.

Each of the stated photosensitive layers may consist of a single layer or may also in a known manner, for example in the so-called double layer arrangement, comprise two or also more silver halide emulsion partial layers (DE-C-1 121 470). In negative films, red-sensitive silver halide emulsion layers are customarily located closer to the film support than the green-sensitive silver halide emulsion layers and these in turn are closer than the blue-sensitive layers, wherein there is generally a non-photosensitive yellow filter layer between the green-sensitive layers and the blue-sensitive layers. Other arrangements are, however, conceivable, for example in colour paper. A non-photosensitive interlayer, which may contain agents to suppress the undesirable diffusion of developer oxidation products, is generally arranged between layers of differing spectral sensitivity. If two or more silver halide emulsion layers of the same spectral sensitivity are present, these may be located immediately adjacent to each other or arranged in such a manner that a photosensitive layer of a differing spectral sensitivity is located between them (DE-A-1 958 709, DE-A-2 530 645, DE-A-2 622 922).

Colour photographic recording materials according to the invention customarily contain colour couplers spatially and spectrally associated with the silver halide emulsion layers of differing spectral sensitivity to produce the different cyan, magenta and yellow partial colour images, wherein the compounds according to the invention are preferably associated, together with the appropriate colour coupler, with a green-sensitive silver halide emulsion layer.

A spatial association should here be taken to mean that the colour coupler is arranged spatially in relation to the silver halide emulsion layer in such a manner that it is possible for them to interact, so permitting the silver image formed on development to be congruent with the colour image produced from the colour coupler. This is generally achieved by the colour coupler being contained in the silver halide layer itself or in an adjacent, optionally non-photosensitive, binder layer.

A spectral association should here be taken to mean that there is a particular relationship between the spectral sensitivity of each of the photosensitive silver halide emulsion layers and the colour of the partial colour image produced from the particular spatially associated colour coupler, wherein each of the spectral sensitivities (red, green, blue) is associated with another colour of the partial colour image concerned (in general, for example, the colours cyan, magenta and yellow, in this order).

One or also more colour couplers may be associated with each of the differently spectrally sensitised silver halide emulsion layers. If two or more silver halide emulsion layers of the same spectral sensitivity are present, each of these may contain a colour coupler, wherein these colour couplers need not necessarily be identical. They should merely produce at least approximately the same colour on colour development, normally a colour which is complementary to the colour of the light to which the particular silver halide emulsion layers are predominantly sensitive.

Colour couplers to produce the cyan partial colour image are as a rule couplers of phenol or α-naphthol type.

Colour couplers to produce the yellow partial colour image are as a rule couplers with an open-chain ketomethylene grouping, in particular couplers of the α-acylacetamide type, for example benzoylanilide couplers and α-pivaloylacetanilide couplers.

Colour couplers to produce the magenta partial colour image are as a rule couplers of a 5-pyrazolone, indazolone or pyrazoloazole type; suitable examples of these are:

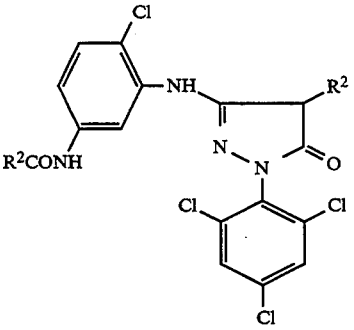

M-1:

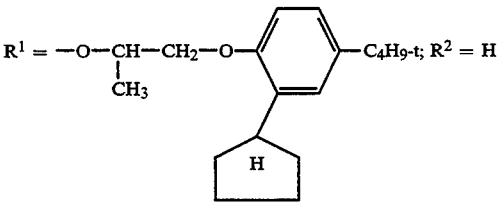

M-2:

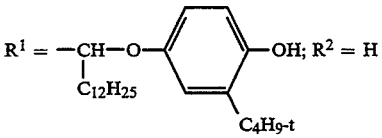

M-3:
$R^1$ = —$C_{13}H_{27}$; $R^2$ = H

M-4:
$R^1$ = —$OC_{16}H_{33}$; $R^2$ = H

M-5:

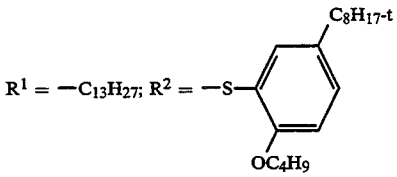

M-6:

-continued
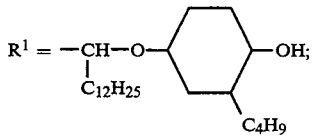
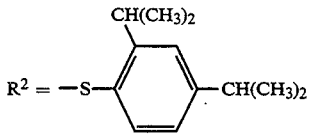
M-7:
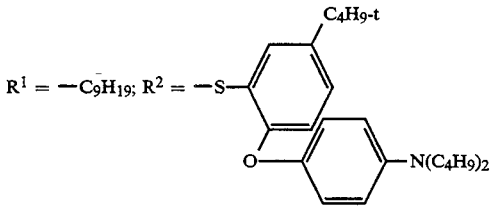
M-8:
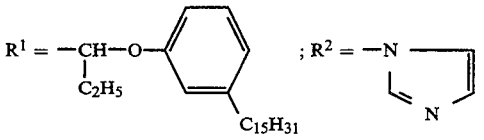
M-9:
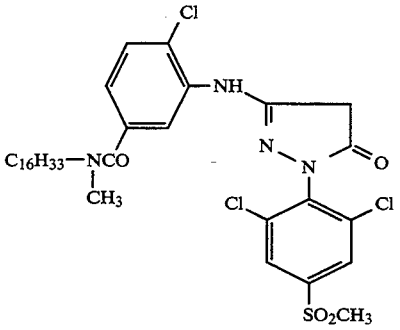
M-10:
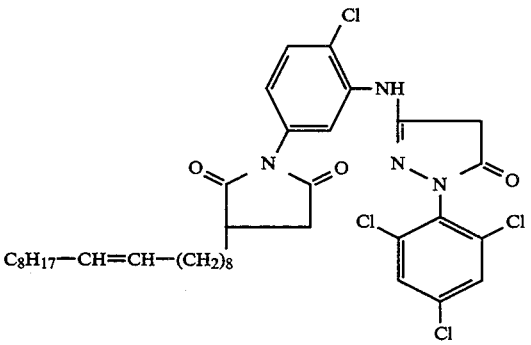
-continued
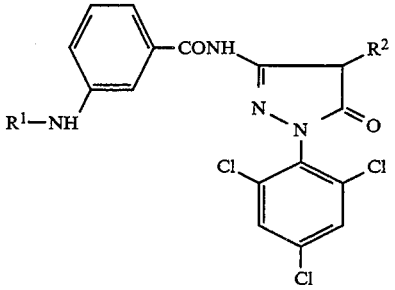
M-11:
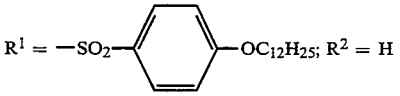
M-12:
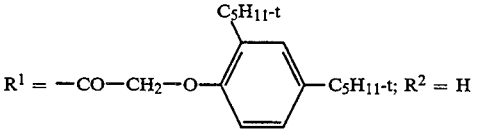
M-13:
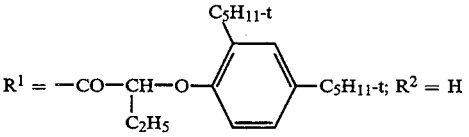
M-14:
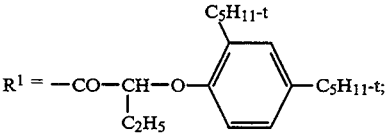
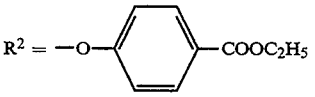
M-15:
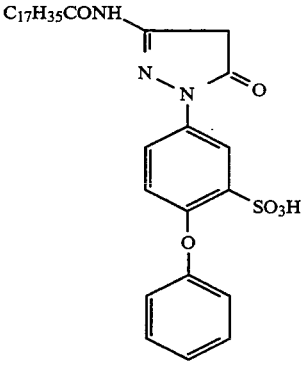
M-16:

-continued

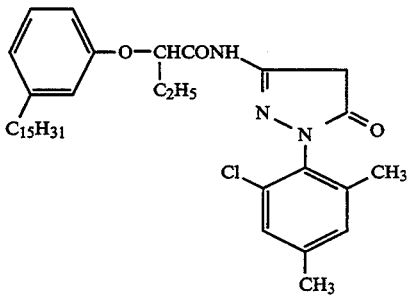

M-17:

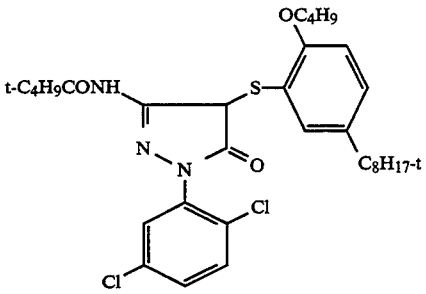

In a preferred embodiment, the recording material of the present invention contains as magenta coupler a compound of the formula IV

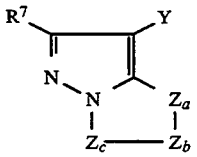

in which $R^7$ means H, alkyl, aralkyl or aryl;

Y means H or a group which may be liberated by coupling;

$Z_a$, $Z_b$, $Z_c$ mean an optionally substituted methine group, =N— or —NH—, wherein either the $Z_a$-$Z_b$ bond or the $Z_b$-$Z_c$ bond is a double bond and the other bond is a single bond.

Couplers of the formula IV are briefly described as pyrazoloazole couplers. Such couplers are, in particular, taken to be couplers derived from imidazolo[1,2-b]pyrazole, imidazolo[3,4-b]pyrazole, pyrazolo[2,3-b]pyrazole, pyrazolo[3,2-c]-1,24-triazole, pyrazolo[2,3-b]-1,2,4-triazole, pyrazolo[2,3-c]-1,2,3-triazole or pyrazolo[2,3-d]tetrazole. The corresponding structures are shown below in the formulae IVa to IVg.

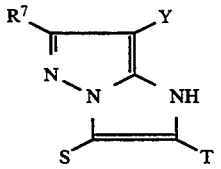

(IVa)

-continued

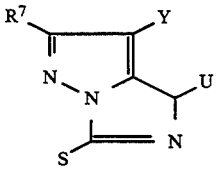

(IVb)

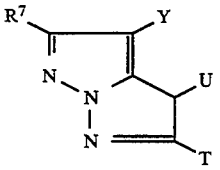

(IVc)

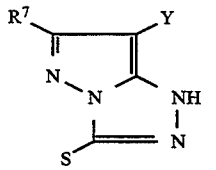

(IVd)

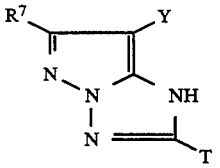

(IVe)

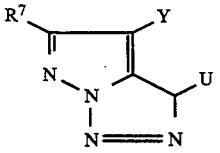

(IVf)

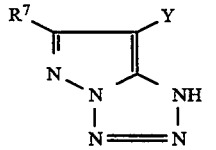

(IVg)

In the general formula IVa to IVg, the residues $R^7$, S, T and U denote hydrogen, alkyl, aralkyl, aryl, alkoxy, aroxy, alkylthio, arylthio, amino, anilino, acylamino, cyano, alkoxycarbonyl, carbamoyl, sulphamoyl, wherein these residues may be further substituted.

Y moreover denotes hydrogen or a residue which may be eliminated on colour coupling, such as a halogen atom or a preferably cyclic group attached to the coupling site via an oxygen atom, a sulphur atom or a nitrogen atom.

If the eliminable group is a cyclic group, the attachment to the coupling site of the coupler molecule may be achieved either directly via an atom which is a constituent part of a ring, for example a nitrogen atom, or indirectly via an intermediate binding link. Such eliminable groups are known in great numbers, for example as the fugitive groups of 2-equivalent magenta couplers.

Examples of eliminable groups attached via oxygen are of the formula

—O—$R^8$, ps in which $R^8$ denotes an acyclic or cyclic organic residue, for example alkyl, aryl, a heterocyclic group or acyl, which is, for example, derived from an organic carboxylic or sulphonic acid. In particularly preferred eliminable groups of this type, $R^8$ means an optionally substituted phenyl group.

Example of eliminable groups attached via nitrogen are described in the following German published patent applications (DE-A-):

25 36 191, 27 03 589, 28 13 522, 33 39 201.

These groups are in many cases 5-membered heterocyclic rings, which are attached to the bonding site of the magenta coupler via a nitrogen atom of the ring. Many of the heterocyclic rings contain activating groups, for example carbonyl or sulphonyl groups, or double bonds adjacent to the nitrogen atom effecting the bond to the coupler molecule.

If the eliminable group is attached to the coupling site o the coupler via a sulphur atom, such groups may be the residue of a diffusible carbocyclic or heterocyclic mercapto compound, which is capable of inhibiting the development of silver halide. Such inhibitor residues have frequently been described as an eliminable group attached to the coupling site of couplers, including magenta couplers, for example in U.S. Pat. No. 3,227,554.

Of the pyrazoloazole couplers of the formulae IVa to IVg, it is preferably those of the formulae IVd and IVe which are used together with the combination of light stabilisers according to the invention. In the formulae IVd and IVe, preferably at least one of the residues $R^7$ and S or at least one of the residues $R^7$ and T denote a secondary alkyl or tertiary alkyl residue, i.e. a residue of the formula

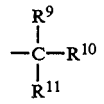

in which $R^9$ and $R^{10}$ denote alkyl and $R^{11}$ denotes hydrogen or a substituent.

Possible substituents are alkyl, aryl, cycloalkyl, hydroxy, halogen, —COOH, —$SO_3H$, —$SO_2H$, alkoxy, aryloxy, alkylthio, arylthio, nitro, sulphonyl, sulphamoyl, sulphonylamino, acylamino, carbamoyl, acyloxy, alkoxycarbonyl, aryloxycarbamoyl, ureido, carbamoyloxy, alkoxycarbonylamino, aryloxycarbonylamino, alkoxycarbonyloxy and aryloxycarbonyloxy.

Preferred substituents are alkyl, sulphonyl, sulphonylamino, sulphamoyl, ureido, acylamino, carbamoyl, alkoxy, aryloxy and alkoxycarbonylamino.

Examples of pyrazoloazole couplers of the formula IV are:

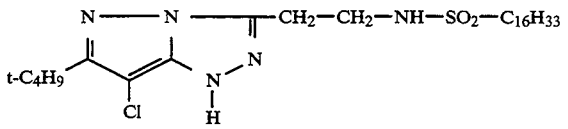

IV-1

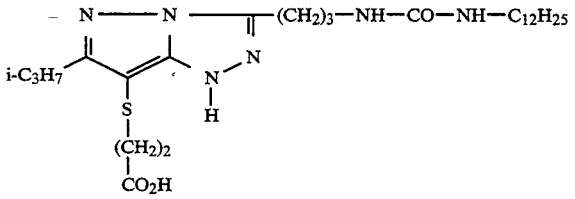

IV-2

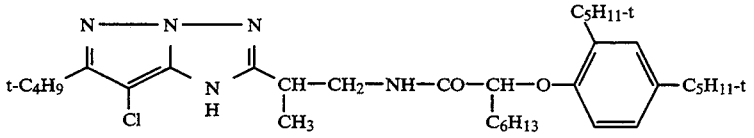

IV-3

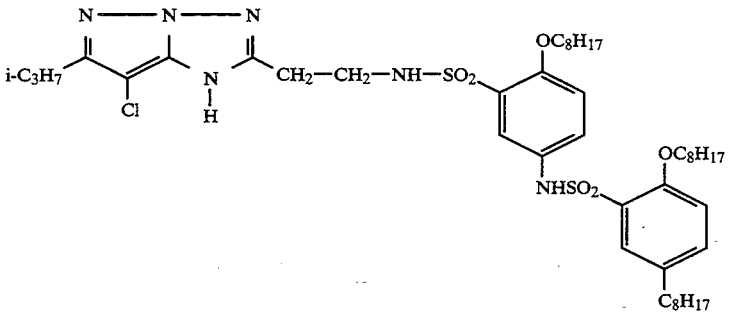

IV-4

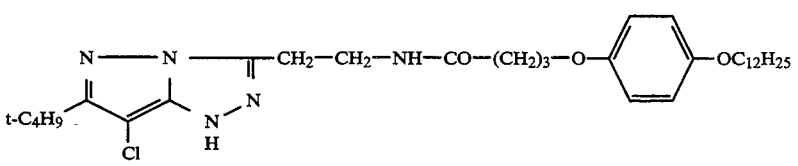

IV-5

-continued
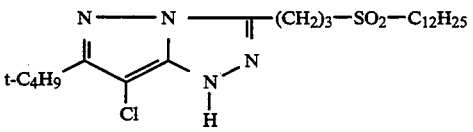
IV-6
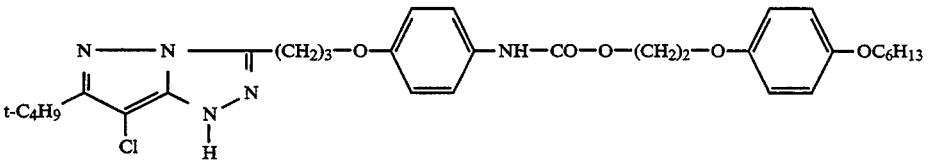
IV-7
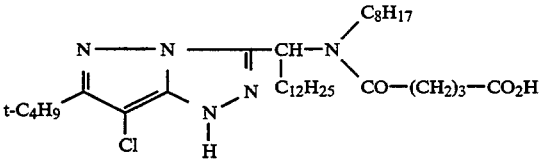
IV-8
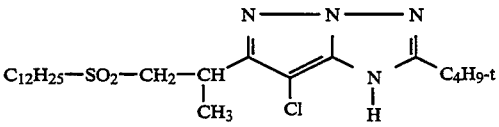
IV-9
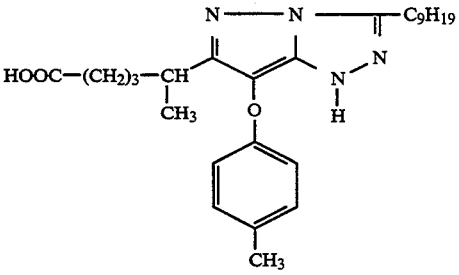
IV-10
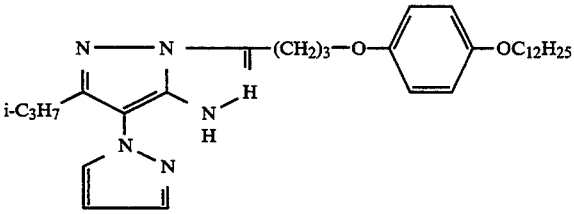
IV-11
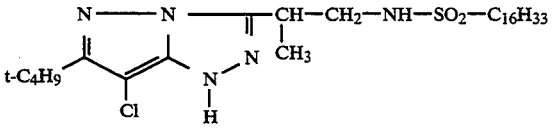
IV-12
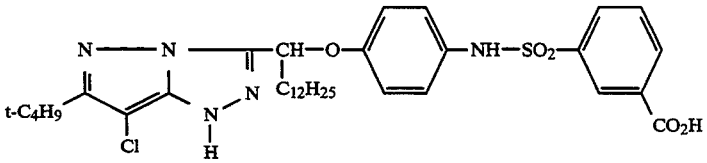
IV-13
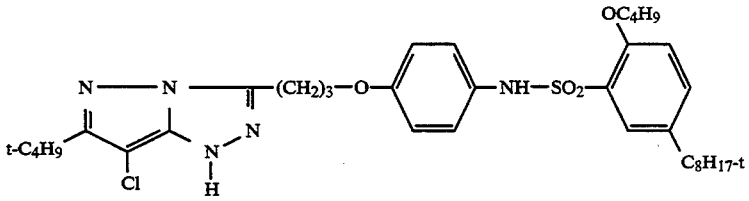
IV-14

-continued
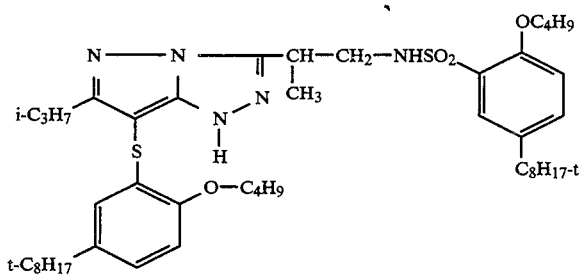
IV-15
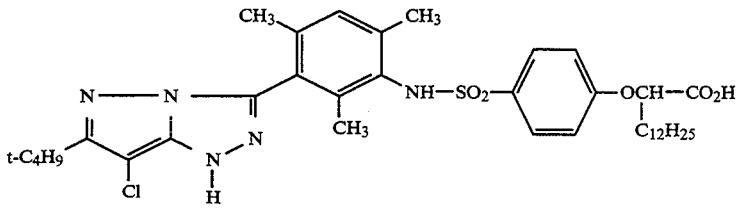
IV-16
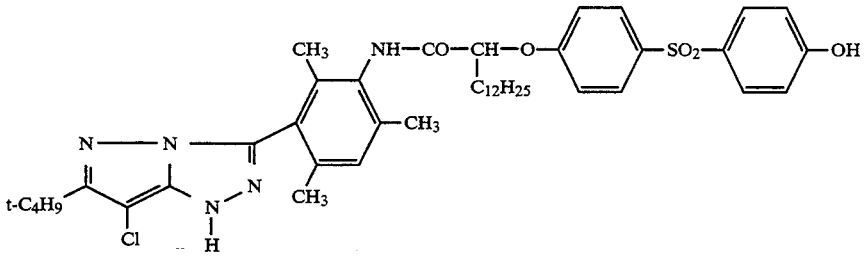
IV-17
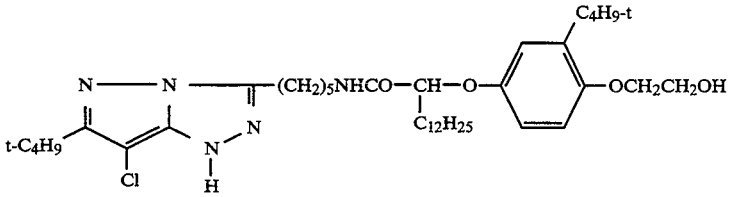
IV-18
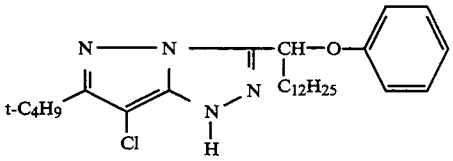
IV-19
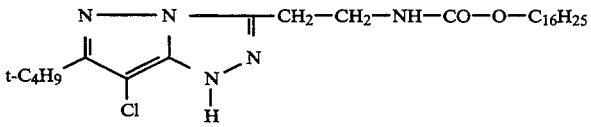
IV-20
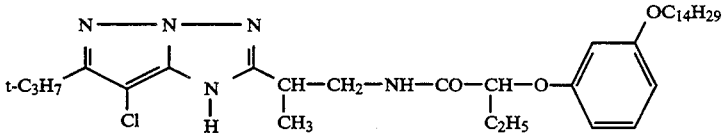
IV-21
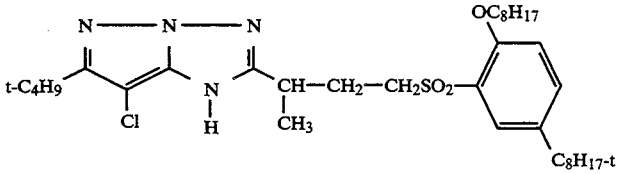
IV-22

-continued
IV-23
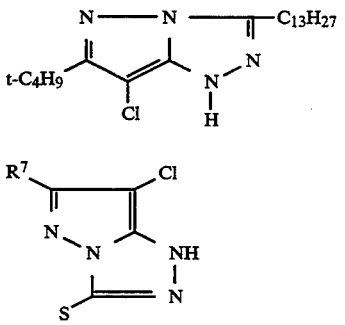
IV-24
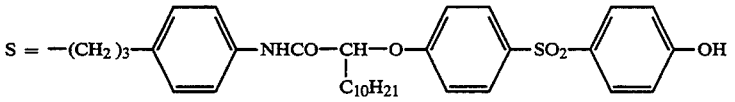
$R^7 = CH_3$
IV-25
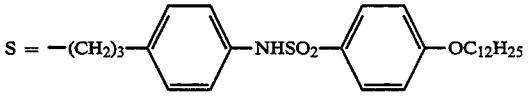
$R^7 = CH_3$
IV-26
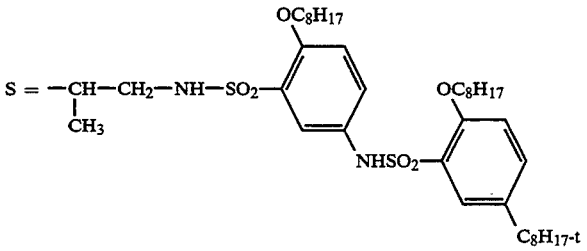
$R^7 = CH_2—CH(CH_3)_2$
IV-27
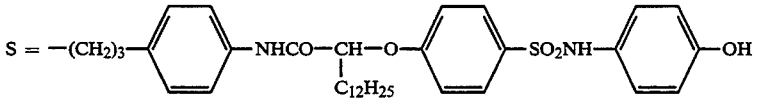
$R^7 = —CH_3$
IV-28
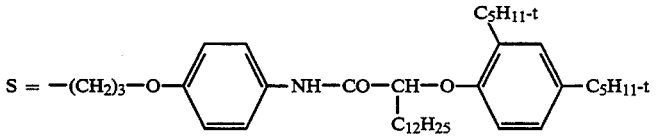
$R^7 = —CH_3$
IV-29
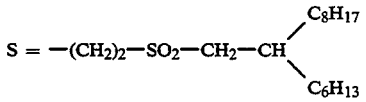
$R^7 = —CH_3$
IV-30
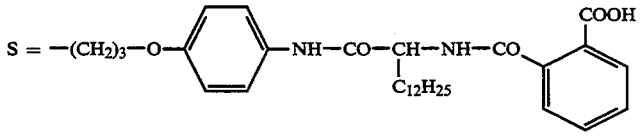
$R^7 = —CH_3$ -continued

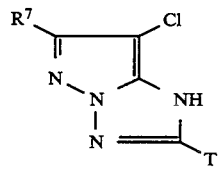

IV-31

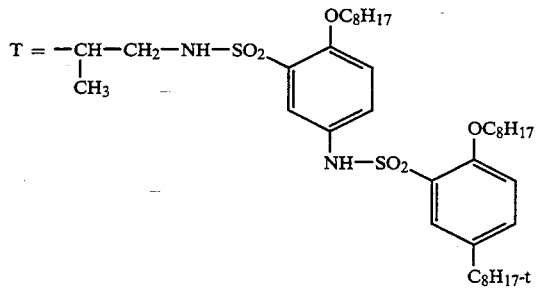

$R^7 = -CH_3$

IV-32

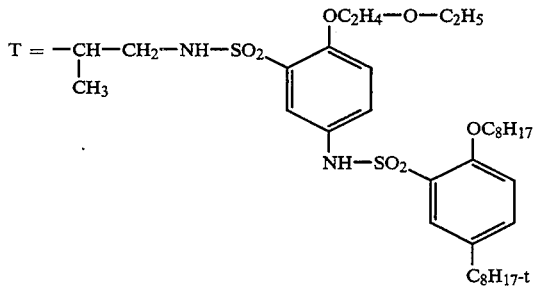

$R^7 = -CH_3$

IV-33

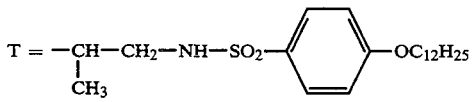

$R^7 = -C_3H_7\text{-n}$

IV-34

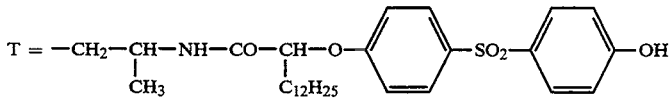

$R^7 = -CH_3$

IV-35

$T = -CH_2-CH_2-OCH_3$

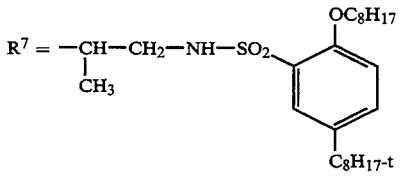

The colour couplers may be 4-equivalent couplers, but they may also be 2-equivalent couplers. The latter are derived from 4-equivalent couplers by containing a substituent at the coupling site which is eliminated on coupling. 2-equivalent couplers are considered to be those which are colourless, as well as those which have an intense intrinsic colour which on colour coupling disappears or is replaced by the colour of the image dye produced (mask couplers), and also white couplers which, on reaction with colour developer oxidation products, give rise to substantially colourless products. 2-equivalent couplers are further considered to be those which contain an eliminable residue at the coupling site, which residue is liberated on reaction with colour developer oxidation products and so either directly or after one or more further groups are eliminated from the initially eliminated residue (for example, DE-A-27 03 145, DE-A-28 55 697, DE-A-31 05 026, DE-A-33 19 428), produces a specific desired photographic effect, for example as a development inhibitor or accelerator.

Examples of such 2-equivalent couplers are the known DIR couplers as well as DAR or FAR couplers.

The couplers used, in particular the pyrazoloazole type magenta couplers preferably used according to the invention, for example of the formulae IVd and IVe, may also be used in polymeric form, for example as a polymer latex.

High molecular weight colour couplers are, for example, described in DE-C-1 297 417, DE-A-24 07 569, DE-A-31 48 125, DE-A-32 17 200, DE-A-33 20 079, DE-A-33 24 932, DE-A-33 31 743, DE-A-33 40 376, EP-A-27 284, U.S. Pat. No. 4,080,211. The high molecular weight colour couplers are generally produced by polymerisation of ethylenically unsaturated monomeric colour couplers.

The colour couplers used may also be those which provide dyes of low or restricted mobility.

Low or restricted mobility should here be understood as mobility which is adjusted such that the contours of the discrete dye spots formed during chromogenic development run and smudge together. This degree of mobility should, on the one hand, be distinguished from the customary complete immobility in photographic layers which, in conventional photographic recording materials, is desirable for the colour couplers or the colour dyes produced from them in order to achieve the greatest possible sharpness, and, on the other hand, from the complete mobility of dyes which is desired, for example, in the dye diffusion process. These latter dyes generally have at least one group rendering them soluble in an alkaline medium. The degree of slight mobility desired according to the invention may be controlled by varying the substituents, for example in order to exert a purposeful influence upon solubility in the organic medium of the oil former or upon affinity for the binder matrix.

In addition to the stated constituents, the colour photographic recording material of the present invention may contain further additives, such as for example antioxidants, dye stabilisers and agents to influence mechanical and electrostatic properties, together with UV absorbers. Such additional compounds are advantageously combined with the compounds according to the invention, i.e. in the same binder layer, or used in adjacent binder layers.

These further additives to improve the stability of dyes, couplers .and whites and to reduce colour fogging (*Research Disclosure* 17 643 (December 1978), section VII) may belong to the following classes of chemical substances: hydroquinones, 6-hydroxychromanes, 5-hydroxycoumarans, spirochromanes, spiroindans, p-alkoxyphenols, sterically hindered phenols, gallic acid derivatives, methylenedioxybenzenes, aminophenols, sterically hindered amines, derivatives with esterified or etherified phenolic hydroxyl groups, metal complexes.

Compounds having both a sterically hindered amine partial structure and a sterically hindered phenol partial structure in one molecule (U.S. Pat. No. 4,268,593) are particularly effective in preventing the degradation of yellow colour images as a consequence of the development of heat, moisture and light.

UV light absorbing compounds are intended on the one hand to protect the colour dyes from bleaching by high-UV daylight and on the other hand to absorb the UV light in daylight on exposure and so improve the colour reproduction of a film. Customarily, compounds of different structure are used for the two tasks. Examples are aryl-substituted benzotriazole compounds (U.S. Pat. No. 3,533,794), 4-thiazolidone compounds: (U.S. Pat. Nos. 3,314,794 and 3,352,681), benzophenone compounds (JP-A-2784/71), cinnamic acid ester compounds (U.S. Pat. Nos. 3,705,805 and 3,707,375), butadiene-compounds (U.S. Pat. No. 4,045,229) or benzoxazole compounds (U.S. Pat. No. 3,700,455).

Examples of particularly suitable compounds are

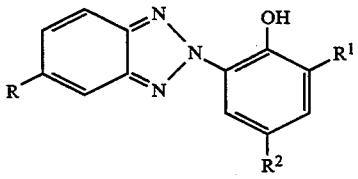

$R, R^1 = H; R^2 = -C_4H_9\text{-t}$
$R = H; R^1, R^2 = -C_4H_9\text{-t}$
$R = H; R^1, R^2 = -C_5H_{11}\text{-t}$
$R = H; R^1 = -C_4H_9\text{-s}; R^2 = -C_4H_9\text{-t}$
$R = Cl; R^1 = -C_4H_9\text{-t}; R^2 = -C_4H_9\text{-s}$
$R = Cl; R^1, R^2 = -C_4H_9\text{-t}$
$R = Cl; R^1 = -C_4H_9\text{-t}; R^2 = -CH_2-CH_2-COOC_8H_{17}$
$R = H; R = -C_4H_9\text{-t}; R^2 = -CH_3$
$R, R^1, R^2 = -C_4H_9\text{-t}$

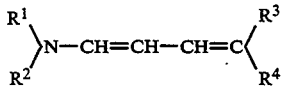

$R^1, R^2 = -C_6H_{13}; R^3, R^4 = -CN$

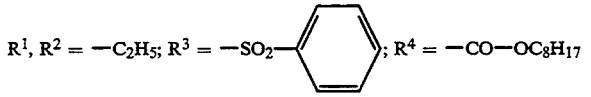

$R^1, R^2 = -C_2H_5; R^3 = -SO_2-$ ; $R^4 = -CO-OC_8H_{17}$

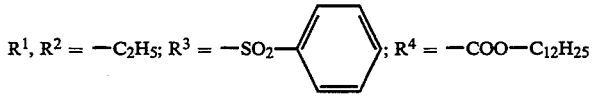

$R^1, R^2 = -C_2H_5; R^3 = -SO_2-$ ; $R^4 = -COO-C_{12}H_{25}$

-continued $R^1, R^2 = -CH_2{=}CH{-}CH_2$; $R^3, R^4 = -CN$

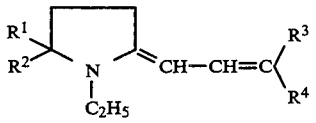

$R^1, R^2 = H$; $R^3 = -CN$; $R^4 = -CO{-}NHC_{12}H_{25}$ $R^1, R^2 = -CH_3$; $R^3 = -CN$; $R^4 = -CO{-}NHC_{12}H_{25}$

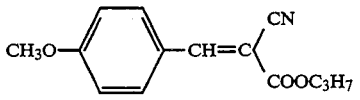

Ultra-violet absorbing couplers (such as cyan couplers of the α-naphthol type) and ultra-violet absorbing polymers may also be used. These ultra-violet absorbents may be fixed into a specific layer by mordanting.

In order to produce colour photographic images, the colour photographic recording material according to the invention, which contains, associated with at least one silver halide emulsion layer, a magenta coupler and a combination of a compound of the formula I and a compound of one of the formulae II and III, is developed with a colour developer. Colour developer compounds which may be used include all developer compounds which, in the form of their oxidation products, are capable of reacting with colour couplers to form azomethine dyes. Suitable colour developer compounds are aromatic compounds containing at least one primary amino group of the p-phenylenediamine type, for example N,N-dialkyl-p-pheneylenediamines such-as N,N-diethyl-p-phenylenediamine, 1-(N-ethyl-N-methanesulphone-amidoethyl)-3-methyl-p-phenylenediamine, 1-(N-ethyl-N-hydroxyethyl)-3-methyl-p-phenylenediamine, 1-(N-ethyl-N-[3-hydroxpropyl])-3-methyl-p-phenylenediamine and 1-(N-ethyl-N-methoxyethyl)-3-methyl-p-phenylenediamine.

Further usable colour developers are, for example, described in *J. Amer. Chem. Soc.* 73, 3100 (1951) and G. Haist *Modern Photographic Processing,* 1979, John Wiley & Sons, New York, pages 545 et seq.

After colour development, the material is customarily bleached and fixed. Bleaching and fixing may be performed separately or together. Bleaches which may be used are the customary compounds, for example $Fe^{3+}$ salts and $Fe^{3+}$ complex salts such as ferricyanides, dichromates, water-soluble cobalt complexes etc. Iron-(III) complexes of aminopolycarboxylic acids, in particular for example of ethylenediaminetetraacetic acid, N-hydroxyethylethylenediaminetriacetic acid, alkyliminodicarboxylic acids and of corresponding phosphonic acids. Persulphates are also suitable bleaches.

EXAMPLE 1

A colour photographic recording material suitable for rapid processing was produced by applying the following layers in the stated order to a film base of paper coated on both sides with polyethylene. The stated quantities all relate to 1 $m^2$. The corresponding quantities of $AgNO_3$ are stated for the applied silver halides.

Layer structure Sample 1

Layer 1: (Substrate layer) 0.2 g gelatine

Layer 2: (Blue-sensitive layer) Blue-sensitive silver halide emulsion (99.5 mol. % chloride, 0.5 mol. % bromide, average grain diameter 0.8 μm) prepared from 0.63 g $AgNO_3$ with 1.38 g gelatine 0.95 g yellow coupler XY-1 0.2 g white coupler XW-1 0.29 g tricresyl phosphate (TCP)

Layer 3: (Protective layer) 1.1 g gelatine 0.06 g 2,5-dioctylhydroquinone 0.06 g dibutyl phthalate (DBP)

Layer 4: (Green-sensitive layer) Green-sensitised silver halide emulsion (99.5 mol. % chloride, 0.5 mol. % bromide, average grain diameter 0.6 μm) prepared from 0.45 g $AgNO_3$ with 1.08 g gelatine 0.41 g magenta coupler IV-6 0.08 g 2,5-dioctylhydroquinone 0.34 g DBP 0.04 g TCP Layer 5: (UV protective layer) 1.15 g gelatine 0.6 g UV absorber UV-1 0.045 g 2,5-dioctylhydroquinone 0.04 g TCP Layer 6: (Red-sensitive layer) Red-sensitised silver halide emulsion (99.5 mol. % chloride, 0.5 mol. % bromide, average grain diameter 0.5 μm) prepared from 0.3 g $AgNO_3$ with 0.75 g gelatine 0.36 g cyan coupler XC-1 0.36 g TCP Layer 7: (UV protective layer) 0.35 g gelatine 0.15 g UV absorber UV-1 0.2 g TCP Layer 8: (Protective layer) 0.9 g gelatine 0.3 g hardener, carbamoylpyridinium salt, CAS registry n° 65411-60-1

The following compounds were used in sample 1:

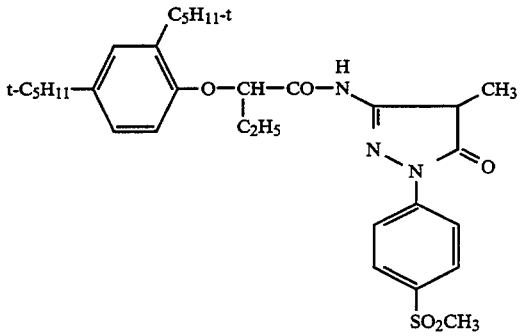

XW-1

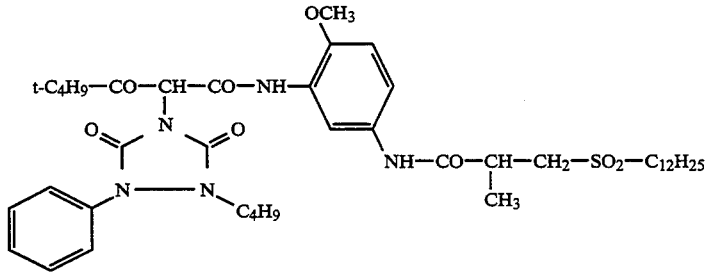

XY-1

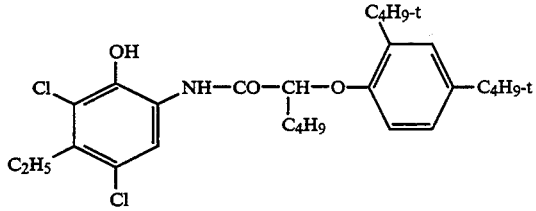

XC-1

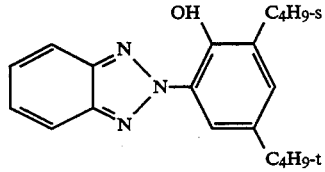

UV-1

Samples 2 to 16

Samples 2 to 16 were produced in the same manner as sample 1, with the difference that the light stabilisers shown in table 1 were additionally incorporated into layer 4.

In samples 9 to 16, the magenta coupler IV-6 was additionally replaced with the magenta coupler IV-23, and DBP and TCP were replaced with 0.20 g of dibutyl adipate and 0.20 g of 2,4-di-tert.-pentylphenol.

The following comparison compounds were used:

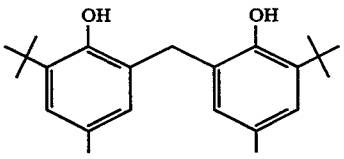

VP-1

-continued

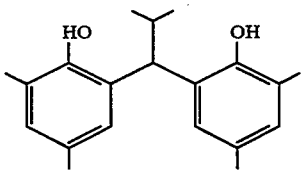

VP-2

The samples were exposed behind a graduated grey wedge and processed as follows in the processing baths listed below.

| | | |
|---|---|---|
| a) | Colour developer - 45 s - 35° C. | |
| | Triethanolamine | 9.0 g |
| | N,N-diethylhydroxylamine | 4.0 g |
| | Diethylene glycol | 0.05 g |
| | 3-methyl-4-amino-N-ethyl-N-methane-sulphonamidoethyl-aniline sulphate | 5.0 g |
| | Potassium sulphite | 0.2 g |
| | Triethylene glycol | 0.05 g |
| | Potassium carbonate | 22 g |
| | Potassium hydroxide | 0.4 g |
| | Ethylenediaminetetraacetic acid, disodium salt | 2.2 g |
| | Potassium chloride | 2.5 g |
| | 1,2-dihydroxybenzene-3,4,6- | 0.3 g |

-continued

| | | |
|---|---|---|
| | trisulphonic acid, trisodium salt | |
| | make up to 1,000 ml with water; pH 10.0 | |
| b) | Bleaching/fixing bath - 45 s - 35° C. | |
| | Ammonium thiosulphate | 75 g |
| | Sodium hydrogen sulphite | 13.5 g |
| | Ammonium acetate | 2.0 g |
| | Ethylenediaminetetraacetic acid (iron-ammonium salt) | 57 g |
| | 25% ammonia | 9.5 g |
| | make up to 1,000 ml with vinegar; pH 5.5 | |
| c) | Rinsing - 2 min - 33° C. | |

The samples were exposed to the light produced by a daylight standardised xenon lamp and given an exposure of $10.0\times10^6$ lx·h; the percentage reductions in density were then measured (table 1).

TABLE 1

(V = comparison; E = according to the invention)

| Sample | Coupler | Light stabiliser (quantity in g) 1 | 2 | 3 | Percentage reduction in density at D = 0.5 | D = 1.0 | D = 1.5 |
|---|---|---|---|---|---|---|---|
| 1 (V) | IV-6 | — | — | — | 89 | 86 | 20 |
| 2 (V) | " | I-20 (0.20) | I-24 (0.20) | — | 45 | 31 | 10 |
| 3 (V) | " | I-2 (0.25) | I-26 (0.20) | — | 47 | 34 | 12 |
| 4 (V) | " | I-20 (0.20) | I-24 (0.20) | VP-1 (0.15) | 46 | 32 | 10 |
| 5 (E) | " | " | " | II-1 (0.15) | 31 | 20 | 6 |
| 6 (E) | " | " | " | II-3 (0.15) | 33 | 21 | 6 |
| 7 (E) | " | I-2 (0.25) | I-26 (0.20) | II-2 (0.25) | 34 | 23 | 8 |
| 8 (E) | " | " | " | III-2 (0.20) | 36 | 23 | 7 |
| 9 (V) | IV-23 | — | — | — | 92 | 89 | 56 |
| 10 (V) | " | I-20 (0.30) | I-15 (0.15) | — | 42 | 36 | 10 |
| 11 (V) | " | I-1 (0.35) | I-21 (0.15) | — | 45 | 38 | 18 |
| 12 (V) | " | I-20 (0.30) | I-15 (0.15) | VP-2 (0.15) | 41 | 35 | 14 |
| 13 (E) | " | " | " | II-5 (0.15) | 32 | 23 | 10 |
| 14 (E) | " | " | " | II-8 (0.15) | 32 | 24 | 11 |
| 15 (E) | " | I-1 (0.35) | I-21 (0.15) | II-7 (0.15) | 36 | 26 | 12 |
| 16 (E) | " | " | " | III-1 (0.20) | 37 | 25 | 11 |

The example shows that the light stability of the dyes is perceptibly further improved by the addition of compounds of the formula II or III to light stabilisers of the formula I. The comparison compounds VP-1 and VP-2, in contrast, do not bring about any further improvement.

EXAMPLE 2

The samples 1, 2, 3, 5 to 8, 9, 10, 11, 13 to 16 were stored for 32 days at 80° C. and 50% relative humidity and the increase in colour fogging and decrease in maximum density were then determined. The results are reproduced in table 2.

TABLE 2

| Sample | Increase in fogging yellow | magenta | cyan | Percentage decrease in density at $D_{max}$ |
|---|---|---|---|---|
| 1 (V) | 13 | 7 | 2 | 4 |
| 2 (V) | 12 | 6 | 2 | 3 |
| 3 (V) | 15 | 7 | 2 | 3 |
| 5 (E) | 8 | 4 | 0 | 1 |
| 6 (E) | 8 | 4 | 1 | 1 |
| 7 (E) | 10 | 5 | 1 | 1 |
| 8 (E) | 11 | 5 | 1 | 2 |
| 9 (V) | 12 | 6 | 1 | 4 |
| 10 (V) | 12 | 5 | 1 | 4 |
| 11 (V) | 13 | 6 | 2 | 3 |
| 13 (E) | 9 | 4 | 0 | 1 |
| 14 (E) | 9 | 4 | 1 | 2 |
| 15 (E) | 8 | 4 | 0 | 1 |
| 16 (E) | 10 | 5 | 1 | 1 |

EXAMPLE 3

This example demonstrates the advantages of the measures according to the invention in a colour reversal film.

Colour photographic recording materials were produced for reversal processing, by applying the following layers in the stated order to a cellulose triacetate film base provided with a coupling layer.

The stated quantities all relate to 1 $m^2$.

Sample 17 (Comparison)

Layer 1 (Anti-halo layer) Black colloidal silver sol with 0.25 g Ag 1.60 g gelatine 0.24 g UV absorber UV-2

Layer 2 (Interlayer) 0.64 g gelatine

Layer 3 (1st red-sensitised layer) Red-sensitised silver bromide-iodide emulsion (25 mol. % iodide, average grain diameter 0.25 μm) prepared from 0.60 g $AgNO_3$ with 0.59 g gelatine 0.24 g cyan coupler XC-2 0.12 g TCP Layer 4 (2nd red-sensitised layer) Red-sensitised silver bromide-iodide emulsion (3.0 mol % iodide; average grain diameter 0.43 μm) prepared from 0.95 g $AgNO_3$ with 1.96 g gelatine 0.95 g cyan coupler XC-2 0.48 g TCP Layer 5 (Interlayer) 1.78 g gelatine 0.24 g compound A 0.12 g TCP Layer 6 (1st green-sensitised layer) 3:1 mixture of a silver bromide-iodide emulsion (1.0 mol. % iodide; average grain diameter 0.26 μm) and a silver bromide-iodide emulsion (4.0 mol. % iodide; average grain diameter 0.21 μm), both green-sensitised, prepared from 0.67 g $AgNO_3$ with 1.13 g gelatine 0.22 g magenta coupler IV-7 0.10 g TCP Layer 7 (2nd green-sensitive layer) Green-sensitised silver bromide-iodide emulsion (1.5 mol. % iodide; average grain diameter 0.42 μm) prepared from 1.05 g $AgNO_3$ with 2.72 g gelatine 1.00 g magenta coupler IV-7 0.45 g TCP Layer 8 (Interlayer) 0.55 g gelatine 0.10 g compound A Layer 9 (Yellow filter layer) Yellow colloidal silver sol with 0.11 g Ag, 0.45 g gelatine Layer 10 (Interlayer) 0.71 g gelatine p1 Layer 11 (1st blue-sensitive layer) Blue-sensitised silver bromide-iodide emulsion (4.0 mol. % iodide; average grain diameter 0.28 μm) prepared from 0.58 g $AgNO_3$ with 1.31 g gelatine 0.24 g yellow coupler XY-2 0.12 g TCP Apart from the already mentioned compounds, the following compounds were used in example 3:

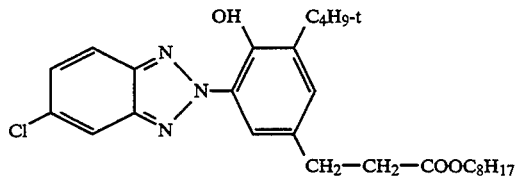

UV-2

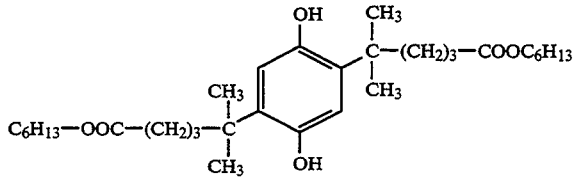

Compound A

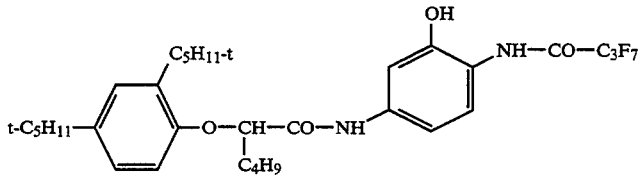

XC-2

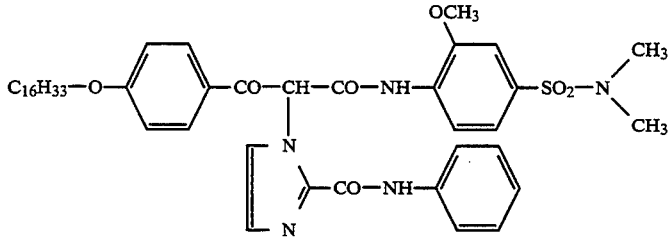

XY-2

Layer 12 (2nd blue-sensitive layer) Blue-sensitised silver bromide-iodide emulsion (3.0 mol. % iodide; average grain diameter 0.66 μm) prepared from 0.66 g $AgNO_3$ 2.04 g gelatine 0.83 g yellow coupler XY-2 0.41 g TCP Layer 13 (Interlayer) 0.76 g gelatine 0.54 g compound A 0.50 g UV absorber UV-1 0.02 g TCP Layer 14 (Protective layer) Micrate silver bromide-iodide emulsion (4.0 mol. % iodide; average grain diameter 0.15 μm) prepared from 0.20 g $AgNO_3$ with 0.57 g gelatine Layer 15 Hardening layer 0.25 g gelatine 0.87 g hardener, carbamoyl pyridinium salt, CAS registry n° 65411-60-1

Samples 18 to 28

Samples 18 to 28 were produced in the same manner as sample 17 with the difference that the quantity of light stabilisers shown in table 3 was added to layers 6 and 7. In each case, the quantity was divided in the ratio 1:5 between the layers 6 and 7. In samples 22 to 28, magenta coupler IV was also replaced with the magenta coupler stated in table 3 (IV-14, IV-23).

The samples prepared were exposed behind a step wedge and subjected to color reversal processing as described in "Manual for Processing Kodak Ektachrome Film Using Process E 7", Eastman Kodak Company, 1977 (see Kodak Publication No. Z-119)

The testing of light stability was made as described in Example 1, the samples were exposed with $7.5 \cdot 10^6$ lux·h. The results are shown in Table 3.

TABLE 3

(V = comparison; E = according to the invention)

| Sample | Coupler | Light stabiliser (quantity [g]) 1 | 2 | 3 | Percentage decrease in density at D = 1.0 | D = 2.0 |
|---|---|---|---|---|---|---|
| 17 (V) | IV-7 | — | — | — | 86 | 50 |
| 18 (V) | IV-7 | I-2 (1.2) | — | — | 40 | 18 |
| 19 (V) | IV-7 | I-17 (0.7) | I-24 (0.5) | — | 41 | 20 |
| 20 (E) | IV-7 | I-2 (1.2) | — | II-5 (0.3) | 29 | 13 |
| 21 (E) | IV-7 | I-17 (0.7) | I-24 (0.5) | II-7 (0.4) | 30 | 15 |
| 22 (V) | IV-14 | — | — | — | 92 | 58 |
| 23 (V) | IV-14 | I-13 (0.6) | I-15 (0.4) | — | 56 | 35 |
| 24 (E) | IV-14 | I-13 (0.6) | I-15 (0.4) | II-1 (0.25) | 39 | 21 |
| 25 (E) | IV-14 | I-13 (0.6) | I-15 (0.4) | III-3 (0.4) | 41 | 24 |
| 26 (V) | IV-33 | — | — | — | 84 | 54 |
| 27 (V) | IV-33 | I-16 (0.6) | — | — | 48 | 29 |

TABLE 3-continued (V = comparison; E = according to the invention)

| Sample | Coupler | Light stabiliser (quantity [g]) 1 | 2 | 3 | Percentage decrease in density at D = 1.0 | D = 2.0 |
|---|---|---|---|---|---|---|
| 28 (E) | IV-33 | I-16 (0.6) | — | II-8 (0.2) | 36 | 21 |

The example shows that the addition of compounds of one of the formulae II and III to magenta dyes stabilised with compounds of the formula I distinctly further improves the light stability of the dye.

We claim:

1. A color photographic recording material comprising at least one silver halide emulsion layer and a color coupler associated with this layer, characterised in that it contains in a silver halide emulsion layer or in an adjacent non-photosensitive binder layer a combination of at least one magenta coupler, at least one compound of the formula I and at least one compound of one of the formulae II or III:

(I)

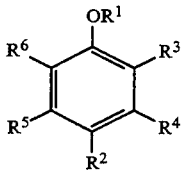

in which $R^1$ means H, alkyl, aryl or acyl;

$R^2$ means $—OR^1$, —COOH, alkyl, aryl, dialkylamino, acylamino, sulphonamido, acyl or sulphonyl;

$R^3$, $R^4$, $R^5$ and $R^6$ are identical or different and mean H, halogen or a residue as $R^2$;

or wherein two adjacent residues $—OR^1$, $R^2$, $R^3$, $R^4$, $R^5$ or $R^6$ complete a 5- to 8-membered ring, (II)

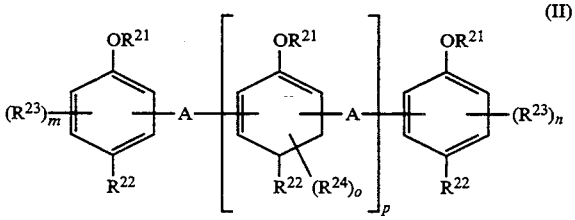

in which $R^{21}$ means residues as $R^1$;

$R^{22}$ means residues as $R^2$;

$R^{23}$ is hydrogen or alkyl, $R^{24}$ means residues as $R^3$;

A means alkylene, —O—, —S—, $—NR^{25}—$ or $—SO_2—$;

$R^{25}$ means a residue as $R^1$;

m and n are identical or different and mean 0, 1, 2, or 3;

o means 0, 1 or 2;

p means a positive integer;

or wherein two or more residues $R^{21}$ to $R^{24}$ are the same or different (the same applies to two or more parameters o) and wherein adjacent residues $—OR^{21}$, $R^{23}$, $R^{22}$ or $—OR^{21}$, $R^{24}$, $R^{22}$ may complete an unsubstituted or substituted 5- or 6-membered ring, and wherein $R^{22}$ is not identical to $—OR^{21}$ if $R^{21}$ is H, (III)

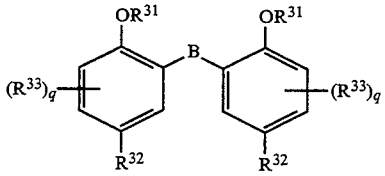

in which $R^{31}$ means residues as $R^1$;

$R^{32}$ means residues as $R^2$;

$R^{33}$ means hydrogen or alkyl;

B means alkylene, —O—, —S—, $—NR^{34}—$ or $—SO_2$;

$R^{34}$ means a residue as $R^1$;

q means 0, 1, 2 or 3;

or wherein two or more residues $R^{31}$ to $R^{33}$ are identical or different, with the restitution that two residues $R^{31}$ are not simultaneously H and wherein adjacent residues $—OR^{31}$ and $R^{33}$ or $R^{32}$ and $R^{33}$ may complete an unsubstituted or substituted 5- or 6-membered ring, and wherein $R^{32}$ is not identical to $—OR^{31}$ if $R^{31}$ is H.

2. The recording material according to claim 1, wherein the compound of the formula I correspond to one of the formulae Ia, Ib, Ic, Id, Ie, If and Ig:

Ia

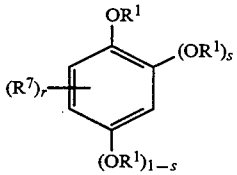

Ib

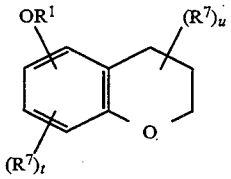

Ic

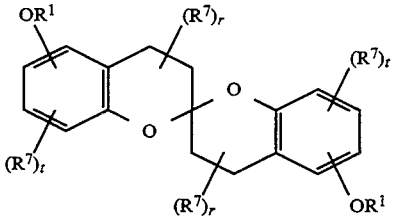

-continued

Id

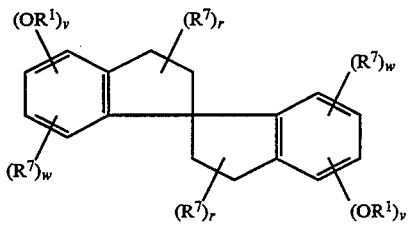

Ie

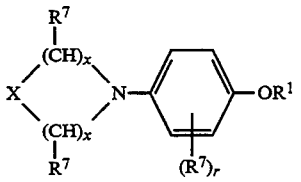

If

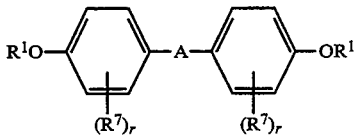

Ig

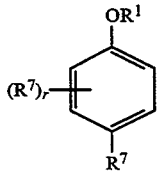

in which $R^7$ means alkyl, acyl, acylamino, sulphonamido or sulphonyl;

X means —O—, —S—, —SO—, —$SO_2$—, —Nacyl— or —CO—;

r means 0, 1, 2, 3 or 4;

s means 0 or 1;

t means 0, 1, 2 or 3;

u means 0, 1, 2, 3, 4, 5 or 6;

v means 1 or 2;

w means 0, 1 or 2; and x means 1, 2 or 3.

3. The recording material according to claim 1, wherein the magenta coupler corresponds to one of the formulae IVd and IVe (IVd)

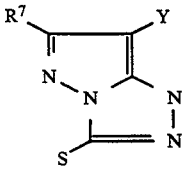

(IVe)

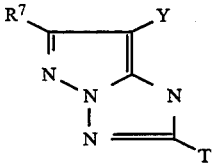

in which the residues $R^7$, S and T are identical or different and denote hydrogen, alkyl, aralkyl, aryl, alkoxy, aroxy, alkylthio, arylthio, amino, anilino, acylamino, cyano, alkoxycarbonyl, carbamoyl or sulphamoyl, wherein at least one of the residues $R^7$ and S (in the formula IVe) or at least one of the residues $R^7$ and T (in the formula IVd) means a secondary alkyl or tertiary alkyl residue, and in which Y denotes hydrogen or a residue which may be eliminated on color coupling.

4. The recording material according to claim 1, wherein the ratio of the total quantity of compounds of the formula I to the total quantity of compounds of one formulae II or III is 1:1 to 10: 1.

5. The recording material according to claim 1, wherein $R^{21}$ and one of the residues $R^{31}$ denote H, and A and B denote alkylene, —$SO_2$— or —S—.

6. The recording material according to claim 1, wherein the ratio of the total quantity of compounds of the formula I to the total quantity of compounds of the formulae II or III is 1:3 to 20:1.

7. The recording material according to claim 1, wherein the magenta coupler is a compound of formula IV

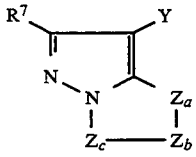

in which $R^7$ means H, alkyl, aralkyl or aryl;

Y means H or a group which is liberated by coupling;

$Z_a$, $Z_b$ and $Z_c$ are identical or different and mean an unsubstituted or substituted methine group, =N— or —NH—, wherein either the $Z_a$-$Z_b$ bond or the $Z_b$-$Z_c$ bond is a double bond and the other bond is a single bond.

* * * * *